US007878827B2

(12) United States Patent
Yao et al.

(10) Patent No.: US 7,878,827 B2
(45) Date of Patent: Feb. 1, 2011

(54) ELECTRICAL CONNECTOR WITH ELECTRICAL DEVICE INCORPORATED THEREIN

(75) Inventors: Zhong-Hua Yao, Kunshan (CN); Jia-Yong He, Kunshan (CN); Qi-Sheng Zheng, Kunshan (CN); Xiao-Min An, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/479,857

(22) Filed: Jun. 8, 2009

(65) Prior Publication Data

US 2009/0305561 A1 Dec. 10, 2009

(30) Foreign Application Priority Data

Jun. 6, 2008 (CN) ..... 2008 2 0038020
Jun. 18, 2008 (CN) ..... 2008 2 0038348

(51) Int. Cl.
*H01R 13/53* (2006.01)

(52) U.S. Cl. ..... 439/181; 439/607.4; 439/620.12; 439/941

(58) Field of Classification Search ..... 439/181, 439/607.4, 620.09, 620.12–620.16, 620.22, 439/620.24, 941, 620.1
See application file for complete search history.

(56) References Cited

U.S. PATENT DOCUMENTS

| | | | | |
|---|---|---|---|---|
| 4,602,838 | A * | 7/1986 | Davis et al. | 439/354 |
| 6,350,152 | B1 * | 2/2002 | Belopolsky et al. | 439/541.5 |
| 6,964,585 | B2 * | 11/2005 | Blichasz et al. | 439/638 |
| 7,682,200 | B2 * | 3/2010 | Zheng et al. | 439/660 |
| 7,708,566 | B2 * | 5/2010 | Sabo et al. | 439/79 |
| 7,717,745 | B2 * | 5/2010 | He et al. | 439/607.23 |
| 2008/0020654 | A1 * | 1/2008 | He et al. | 439/855 |

* cited by examiner

*Primary Examiner*—Hae Moon Hyeon
(74) *Attorney, Agent, or Firm*—Wei Te Chung; Andrew C. Cheng; Ming Chieh Chang

(57) ABSTRACT

An electrical connector includes an insulative housing, a number of electrical contacts and an IC (Integral Circuit). The insulative housing has a body and a contact insert received in the body. The electrical contacts are secured to the contact insert and each has a mating end, a solder end projecting out of the insulative housing and a connecting end located therebetween. The IC is bonded to contact insert for electrical connecting with the connecting ends of the electrical contacts, respectively.

15 Claims, 10 Drawing Sheets

ELECTRICAL CONNECTOR WITH ELECTRICAL DEVICE INCORPORATED THEREIN

BACKGROUND OF THE INVENTION

1. Field of the Invention

The present invention relates generally to electrical connector, and more particularly to a connector having an electrical device carried thereon.

2. Description of Related Art

Electrical connectors are typically used to couple PCB (Printed Circuit Board) which have numerous electrical devices. Some electrical connectors have a mating end wherein conductive terminals are exposed for engagement with the terminals of a mating connector. When mating the connectors, opposite charges at the connector interface may result in an Electrostatic Discharge (ESD) between the two connectors. In fact, electrostatic discharges can be generated simply by a person approaching or touching the connector interface or touching the terminal contacts. As known, when the ambient relative humidity drops to fifty percent or below, the human body accumulates a large number of electrical charges which can be in excess of 20,000 volts. Generally, very little current is associated with an electrostatic discharge; however, the voltage can be high enough to damage or destroy certain types of electrical devices such as semiconductor devices. Consequently, when the connector contacts or terminals are electrically associated with such devices on a circuit board, the electrostatic discharge may damage or destroy the electrical devices on the circuit board.

In order to alleviate the electrostatic discharge problem, some electrical connectors include features to provide ESD protection. In at least some connectors, ESD protection is provided with a shield in the form of a plate, bar, or the like located proximate the connector interface and connected to ground on or proximate the connector. In the same time, the circuit boards which the connectors mounted also provide ESD protection such as IC (Integral Circuit) to prevent the damage of the ESD. Nowadays, there is a trend that computers and handset devices such as mobile phones, digital cameras, MP3, PDA are need to provide more and more functions. Accordingly, the input/output connectors of above systems are increased which can result in the ESD entering the systems and destroying the electrical devices on the circuit board more frequently. Furthermore, with the addition of characteristics and the integration of functions, the designs of the PCB and the IC mounted thereon become sensitive about the ESD. Therefore, the ESD protections disposed on the circuit board not only occupy space thereof but also increases the complexity of the circuit board.

Hence, it is desired a connector can integrate the ESD protection therein instead of the PCB.

BRIEF SUMMARY OF THE INVENTION

Accordingly, an object of the present invention is to provide an electrical connector with an IC integral thereon for protection.

In order to obtain the object, an electrical connector comprises an insulative housing, a plurality electrical contacts and an IC (Integral Circuit). The insulative housing has a body and a contact insert and said body comprises a base and a tongue projecting from the base. Said base defines a receiving space for receiving the contact insert. The electrical contacts are secured to the contact insert and each comprises a mating end arranged on the tongue, a solder end projecting out of the insulative housing and at least one connecting end located therebetween. The IC is bonded to contact insert and comprises a plurality of contact pads for electrical connecting with the connecting ends of the electrical contacts respectively.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
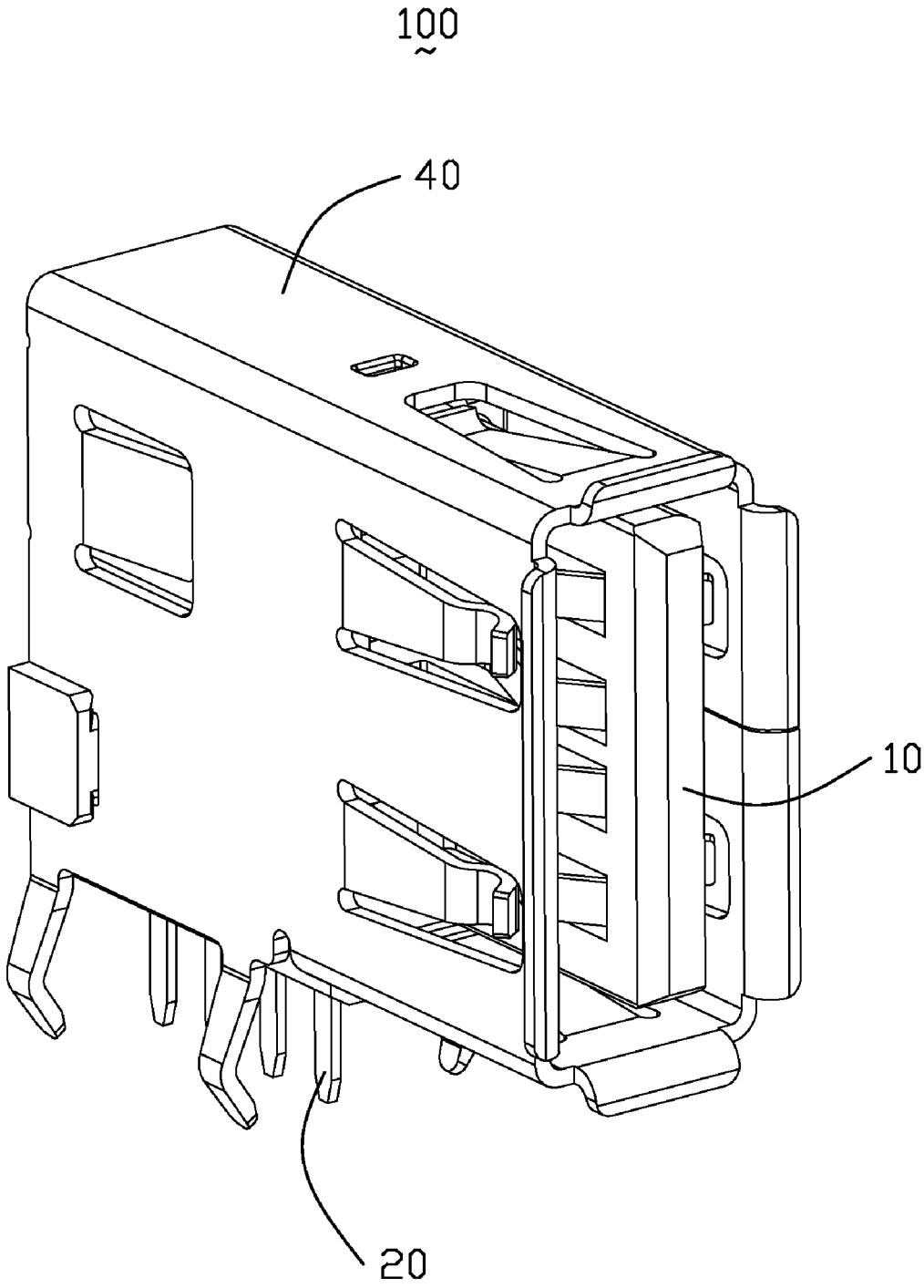
FIG. 1 is a perspective view of an electrical connector according to a first embodiment of the present invention.

Reference will be made to the drawing figures to describe the present invention in detail, wherein depicted elements are not necessarily shown to scale and wherein like of similar elements are designated by same or similar reference numeral through the several views and same or similar terminology.

Figure 2:
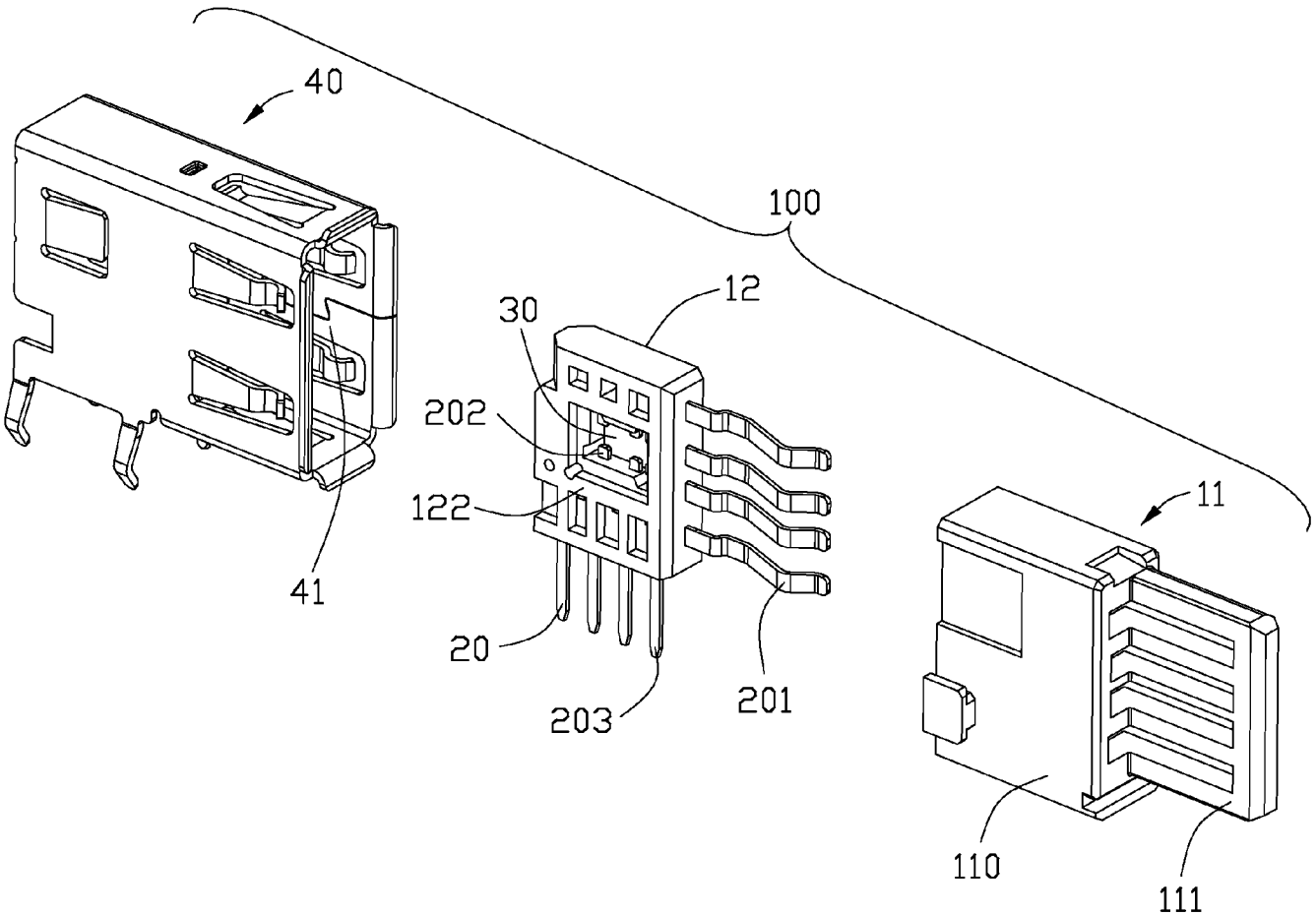
FIG. 2 is an exploded view of the electrical connector shown in FIG. 1.
Figure 3:
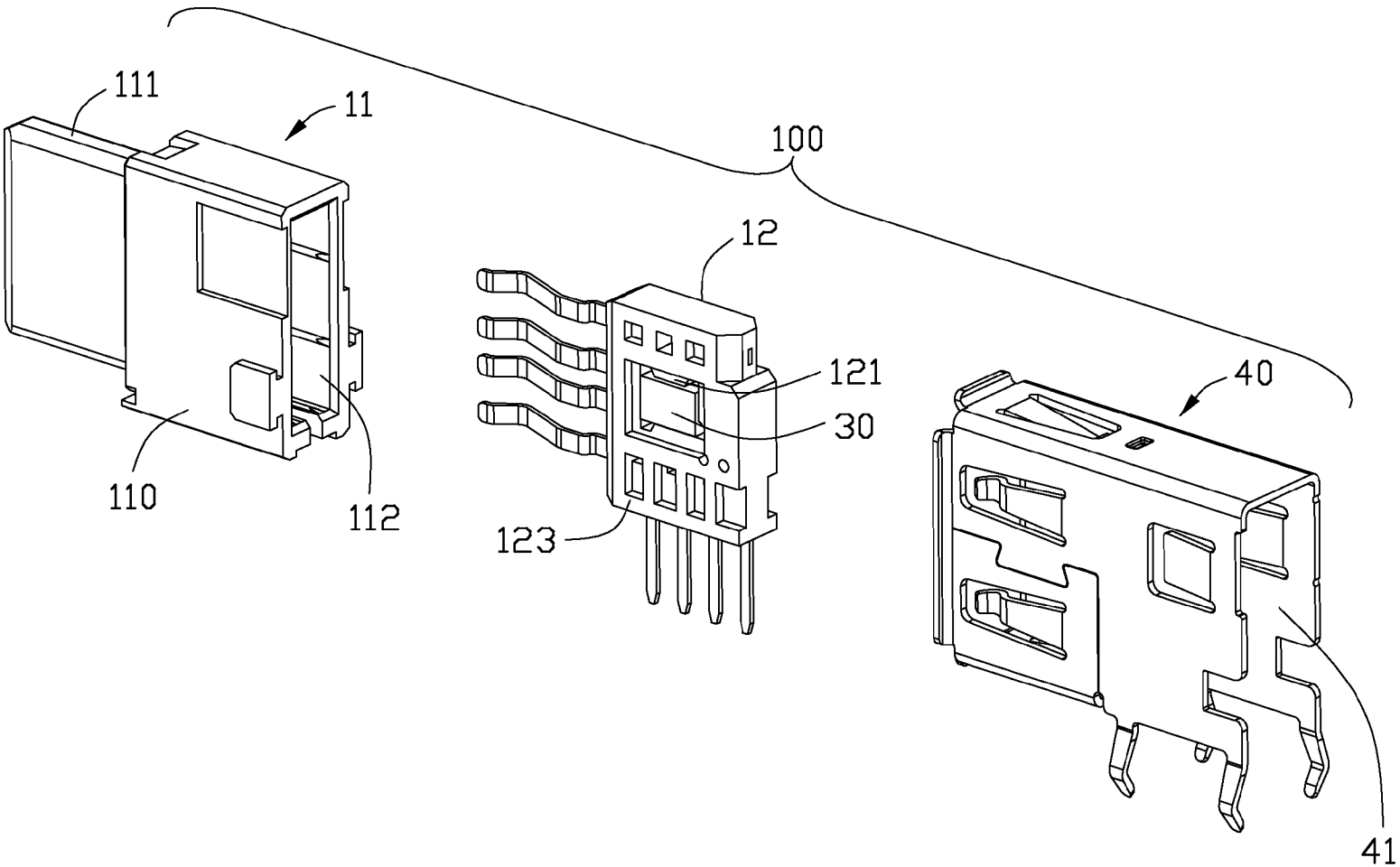
FIG. 3 is another exploded view of the electrical connector shown in FIG. 1, while taken from a different aspect.

Referring to FIGS. 1-3, the present invention is directed to an electrical connector 100 mounting to a printed circuit board (not shown) having an insulative housing 10, a plurality of electrical contacts 20 attached to the insulative housing 10, an electrical device 30 electrically connected with the electrical contacts 20, and a metal shell 40 with a receiving space 41 for accommodating above-mentioned elements. The insulative housing 10 includes a body 11 and a contact insert 12 secured to the body 11. The contact insert 12 is configured by a plurality of contacts integrally formed with an insulative support. The body 11 has a base 110 and a tongue 111 extending from base 110 and the base 110 defines a receiving space 112 for receiving the contact insert 12.

Figure 4:
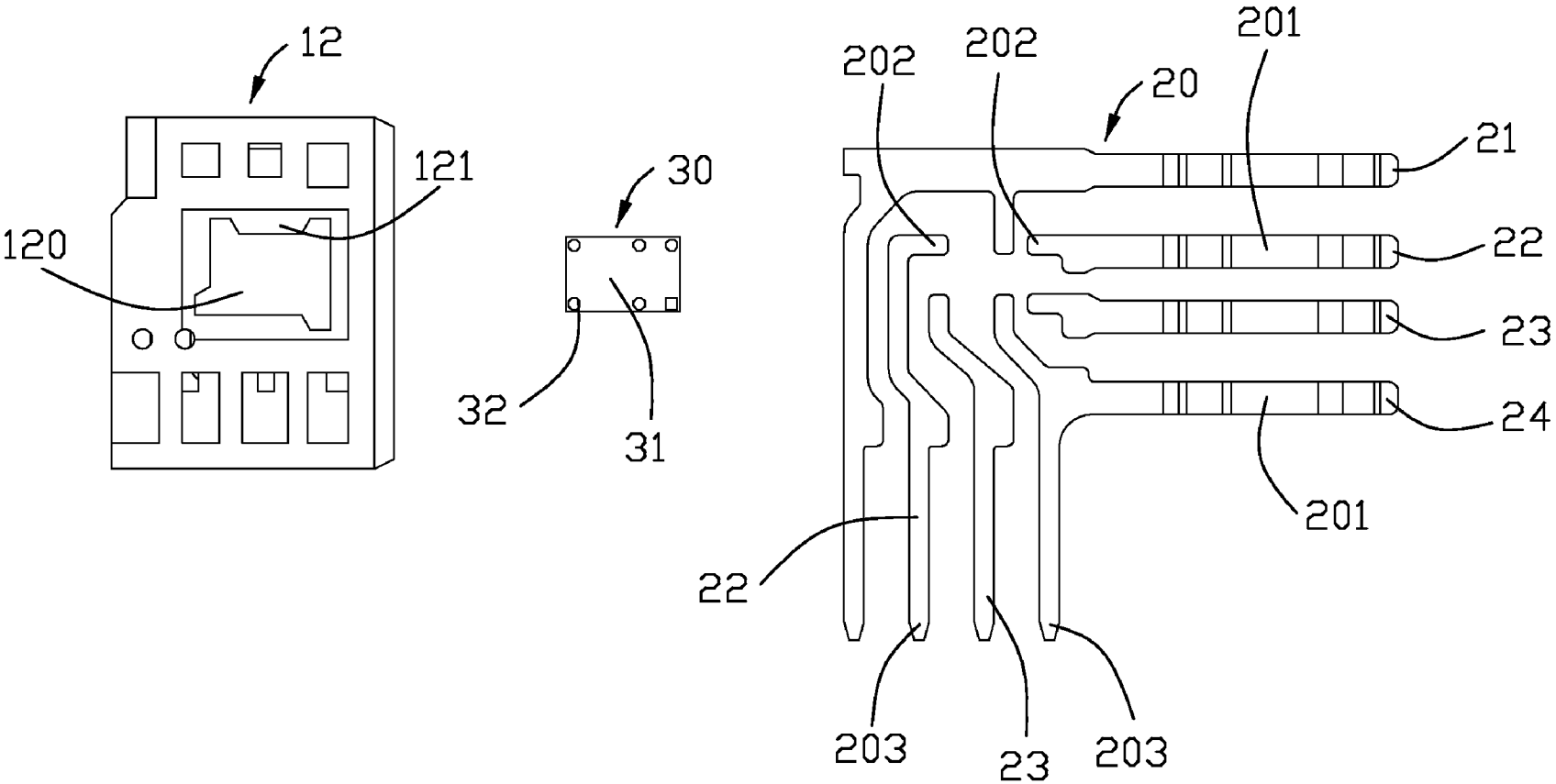
FIG. 4 is a side view of the insulative housing, electrical device and contacts shown in FIG. 2.
Figure 5:
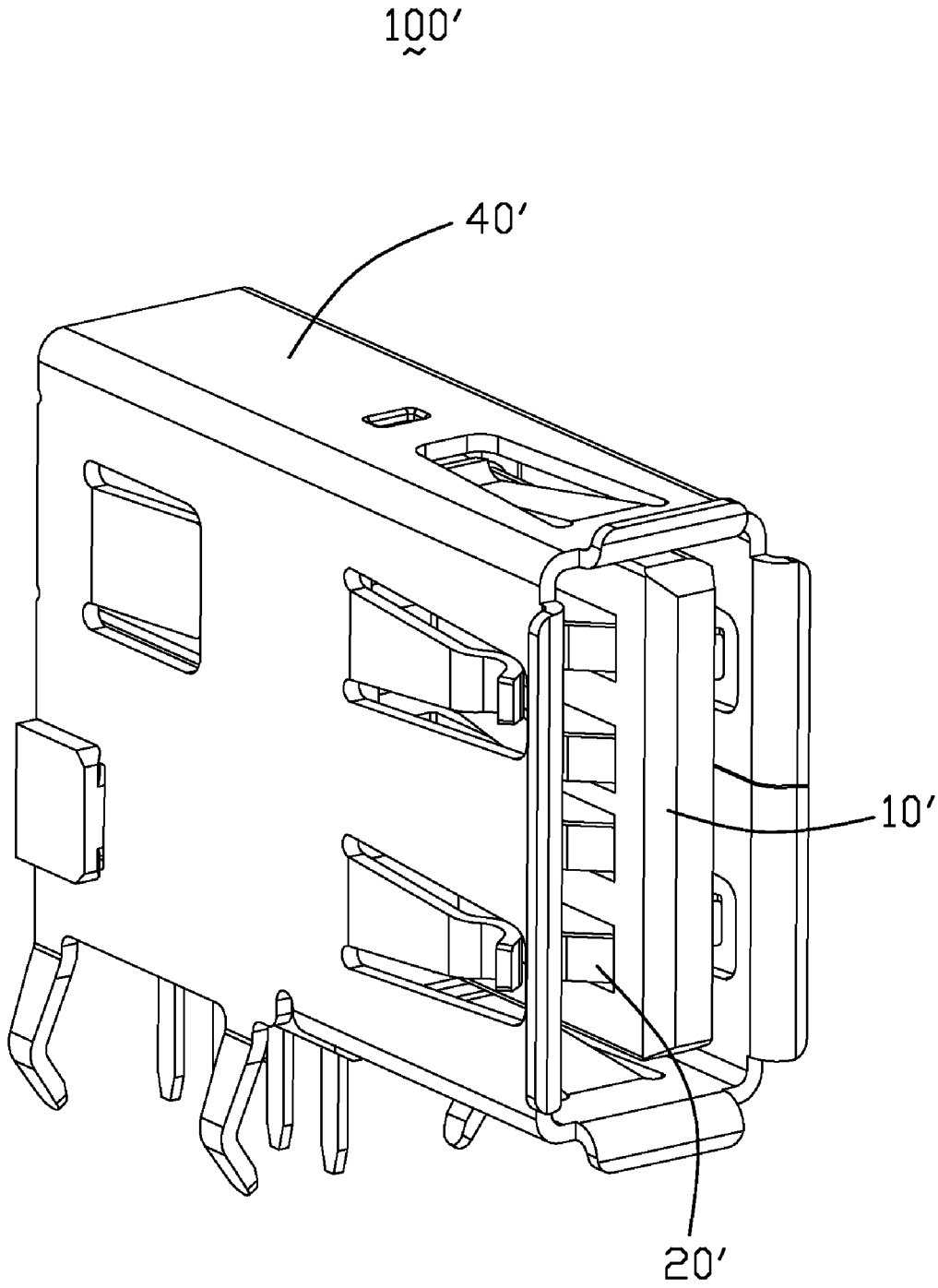
FIG. 5 is a perspective view of an electrical connector according to a second embodiment of the present invention.

Please refer to FIGS. 2 to 4, the contact insert 12 defines a recess 120 with a plurality of supporting sections 121 projecting into the recess 120. The contact insert has a pair of opposite side faces 122, 123.

The electrical contacts 20 are insert-molded on the contact insert 12 and have two types. One type of the electrical contacts 22, 23 has two separated sections and the other type of the contacts 21, 24 is integral. Each of the electrical contacts 20 comprises a mating end 201 arranged on the tongue 111, a solder end 203 extending out of the contact insert 12, and one or two connecting ends 202 disposed in the contact insert 12. As shown in FIG. 4, the contact 22, 23 with two separated sections each has two connecting ends 202, and one separated section is the mating end 201 and the other is the solder end 203. The two connecting ends 202 are defined on the two separated sections respectively and the two separated sections of the separated contacts 22, 23 are electrical with each other by the electrical device 30.

The contact insert 12 includes first, second, third and fourth contact terminals, 21, 22, 23 and 24. The first and fourth contacts 21 and 24 are one-piece contact, and the second and third contacts 22, 23 are two-piece contact, i.e. each of the contacts 22, 23 are configured by first part and then interconnected by the electronic device 30. The integral contacts 21, 24 each only have a connecting end 202, and the mating end 201 and solder end 203 thereof are integral. The mating ends 201 and solder ends 203 of the electrical contacts 20 are located in one plane.

As illustrated in FIGS. 2 to 4, the electrical device 30 is an integral circuit (IC) for providing ESD protection and comprises an insulative section 31 and a plurality of contacting pads 32. The electrical device 30 is received in the recess 120 of the contact insert 12 and assembled thereto along a direction perpendicular to the side faces 122, 123. The electrical device 30 is supported by the supporting sections 121 on the contact insert 12. The connecting ends 202 of the electrical contacts 20 are solder to the contacting pads 32 of the electrical device 30, respectively thereby establishing electrical connection with the electrical contacts 20 and securing to the contact insert 12.

FIGS. 6 to 10 show a second embodiment according to the present invention. The electrical connector 100' mounting to a printed circuit board (not shown) having an insulative housing 10', a plurality of electrical contacts 20' attached to the insulative housing 10', an electrical device 30' electrically connected with the electrical contacts 20', and a metal shell 40' with a receiving space 41' for receiving above-mentioned elements. The insulative housing 10' includes a body 11' and a contact insert 12' secured to the body 11'. The body 11' has a base 110' and a tongue 111' extending from base 110' and the base 110' defines a receiving space 112' for receiving the contact insert 12'.

Figure 6:
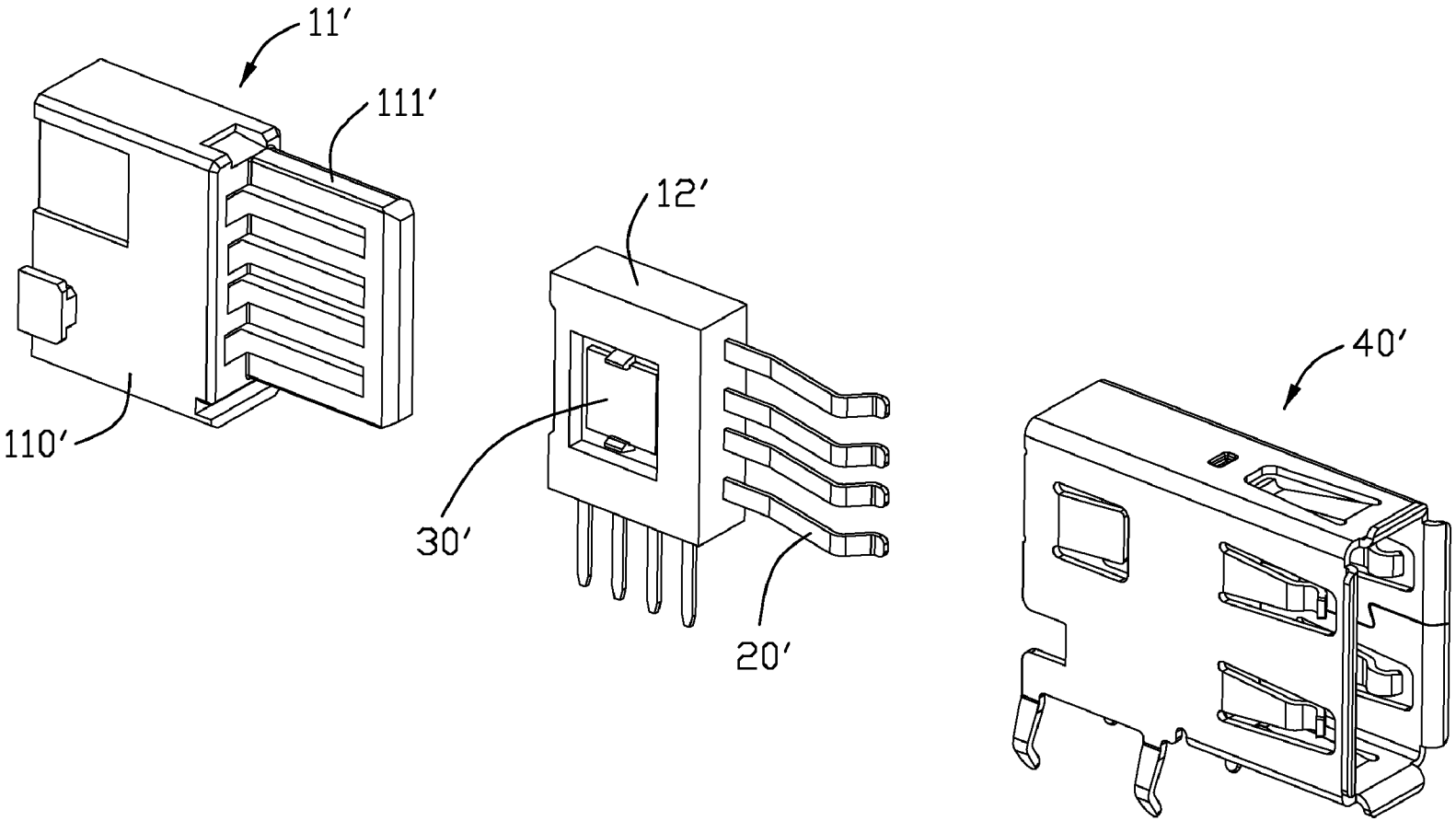
FIG. 6 is an exploded view of the electrical connector shown in FIG. 5.
Figure 7:
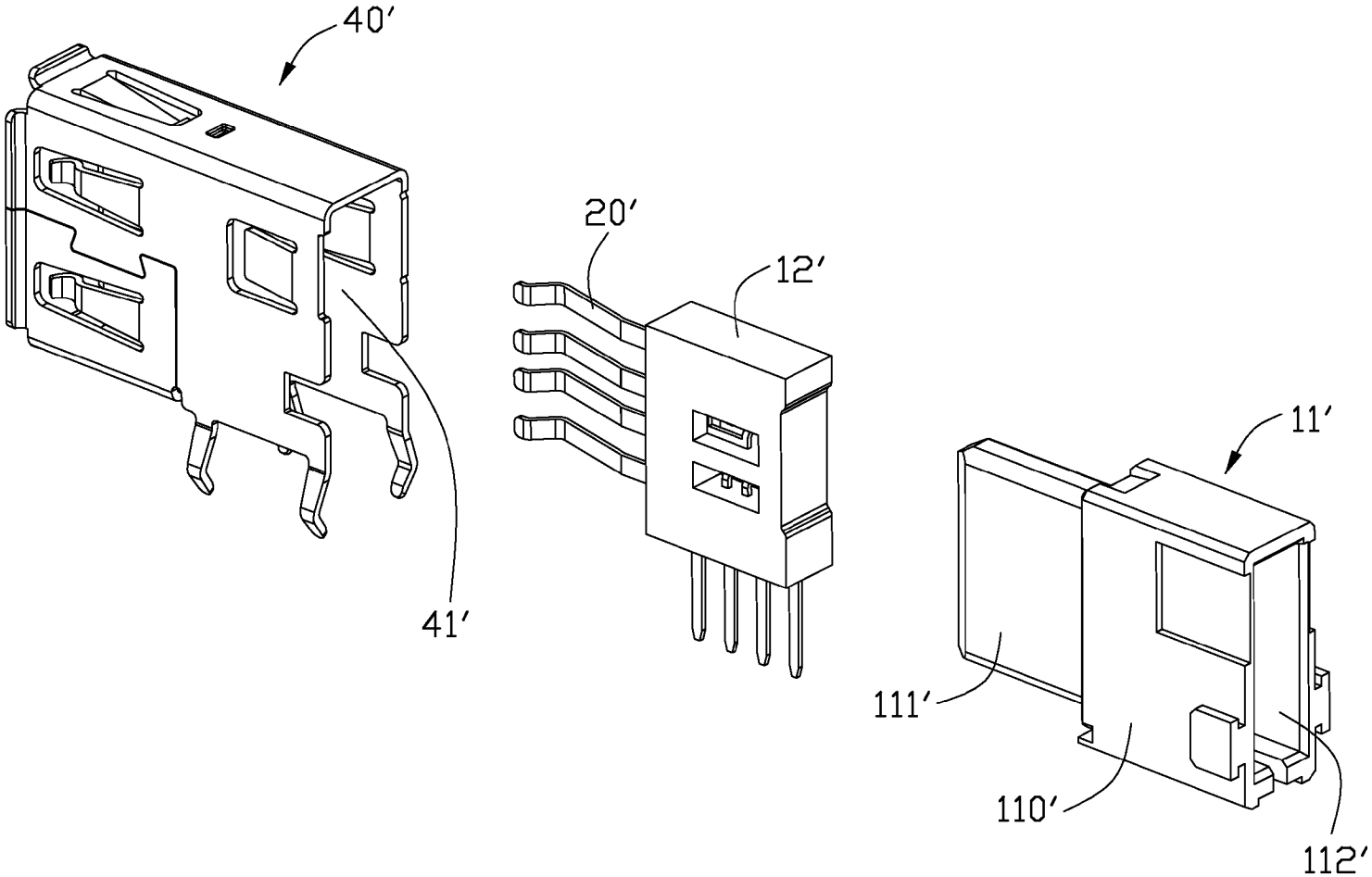
FIG. 7 is another exploded view of the electrical connector shown in FIG. 5, while taken from a different aspect.
Figure 8:
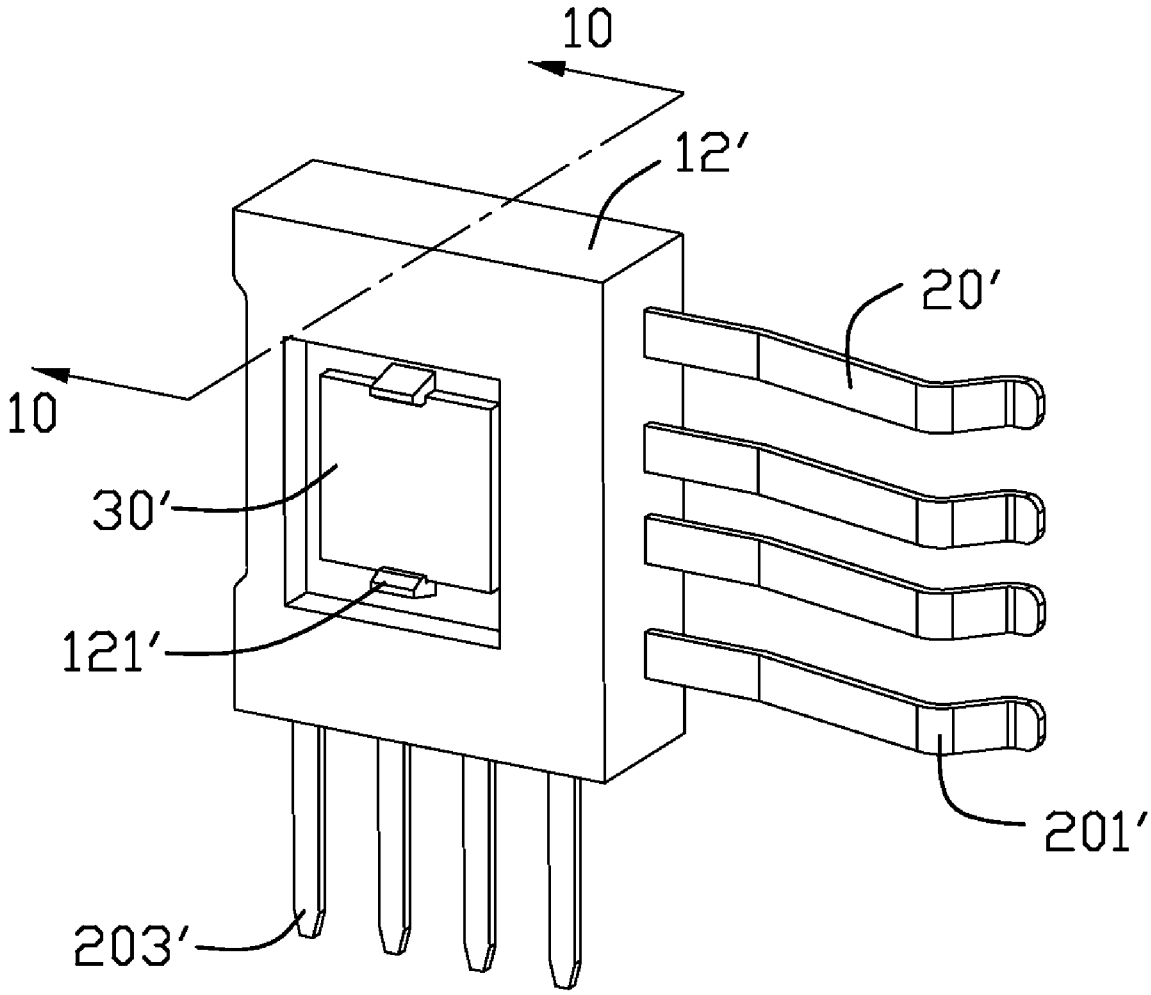
FIG. 8 is a perspective view of the insulative housing, electrical device and contacts shown in FIG. 6.

Please refer to FIGS. 6 to 8, the contact insert 12' defines a recess 120' with a plurality of supporting sections 121' projecting into the recess 120. The contact insert 12' has a pair of opposite side faces 123', 124'. The contact insert 12' has a support section 122' for supporting the electrical device 30' and a plurality clips 121' adjacent to the recess 120'.

Figure 9:
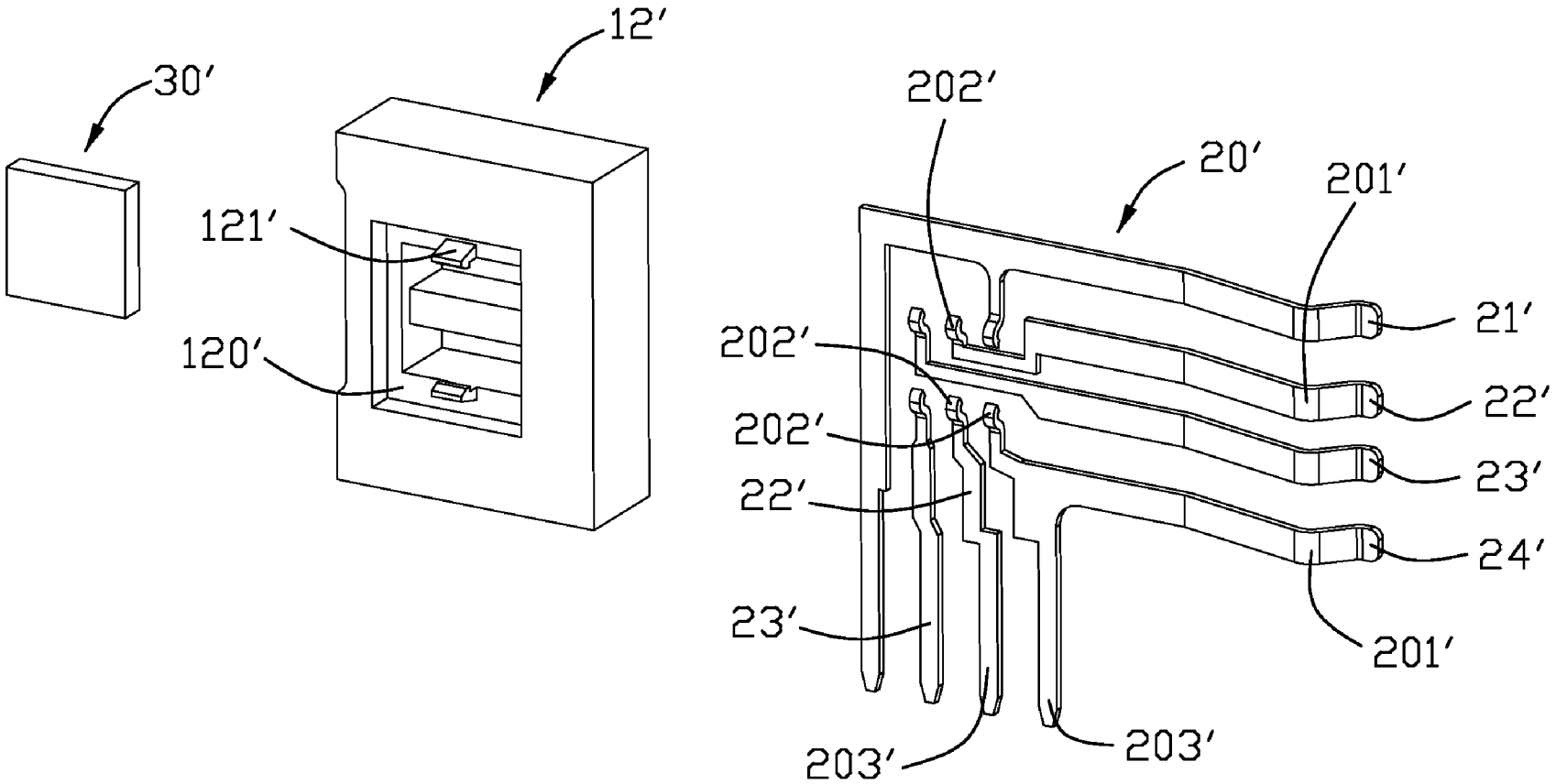
FIG. 9 is an exploded view of the insulative housing, electrical device and contacts shown in FIG. 6.
Figure 10:
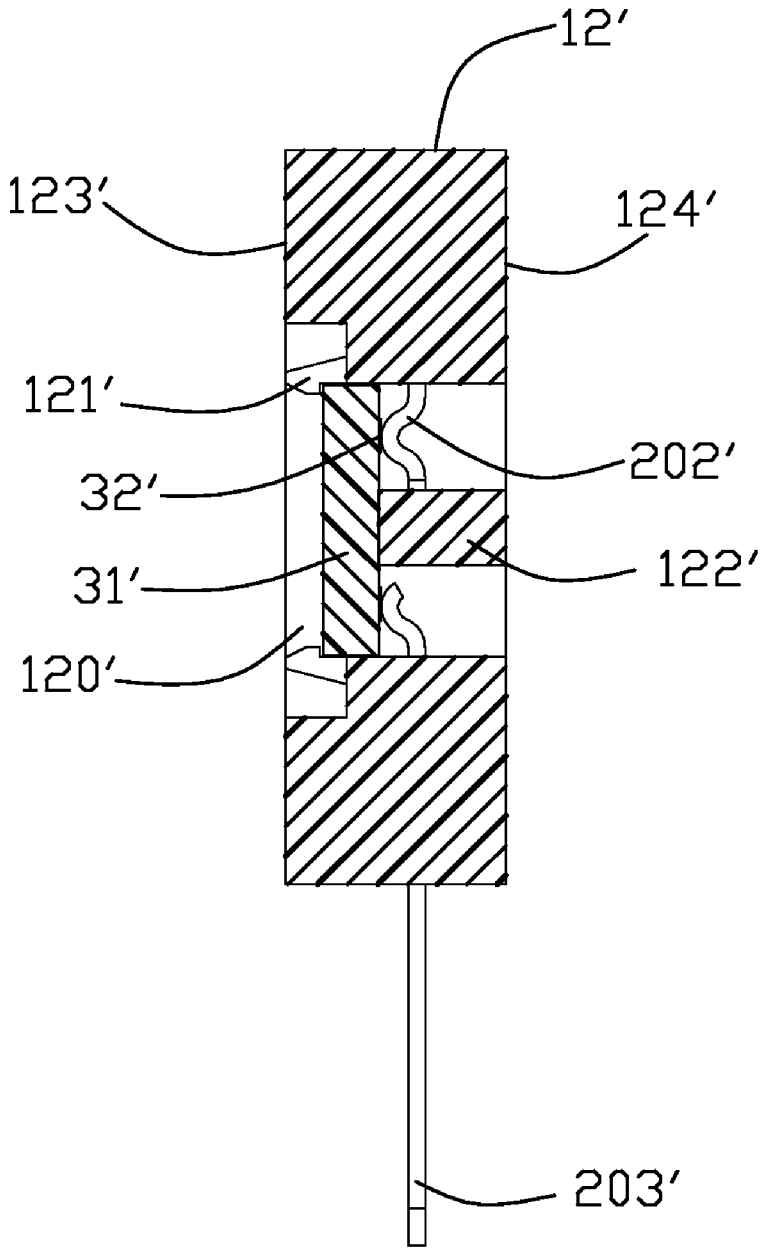
FIG. 10 is a cross-sectional view taken along line 10-10 shown in FIG. 8.

Please refer to FIGS. 9 to 10, the electrical contacts 20' are insert-molded on the contact insert 12' and have two types. One type of the electrical contacts 22', 23' has two separated sections and the other type of the electrical contacts 21', 24' are integral. Each of the electrical contacts 20' comprises a mating end 201' arranged on the tongue 111', a solder end 203' extending out of the contact insert 12', and one or two connecting ends 202' disposed in the contact insert 12'. As shown in FIG. 9, the contact 22', 23' with two separated sections each has two connecting ends 202', and one separated section is the mating end 201' and the other is the solder end 203'. The two connecting ends 202' are defined on the two separated sections respectively and the two separated sections of the separated contacts 22', 23' are electrical with each other by the electrical device 30'.

The integral contacts 21', 24' each only have a connecting end 202', and the mating end 201' and solder end 203' thereof are integral. The mating ends 201' and solder ends 203' of the electrical contacts 20' are located in one plane. Each connecting end 203' has a projection for contacting with the electrical device 30', and the connecting ends 203' and the clips 121' of the contact insert 12' are located at opposite sides of the electrical device 30' for securing the electrical device 30' therebetween.

As illustrated in FIGS. 8 to 10, the electrical device 30' is an integral circuit (IC) for providing ESD protection and comprises an insulative section 31' and a plurality of contacting pads 32'. The electrical device 30' is received in the recess 120' of the contact insert 12' and assembled thereto along a direction perpendicular to the side faces 123', 124'. The electrical device 30' is supported by the supporting sections 122' on the contact insert 12. The connecting ends 202' of the electrical contacts 20' is in contact with the contacting pads 32' of the electrical device 30', respectively thereby establishing electrical connection therewith and securing to the contact insert 12'.

The contacts 22, 23, 22', 23' are mechanically and electrically connected to the corresponding contacting pads 32, 32' with a series connection relation with the IC 30, 30' while the remainder contacts 21, 24, 21', 24' are mechanically and electrically connected to the other corresponding contacting pads 32, 32' with a parallel connection relation with the IC 30, 30'. The contacts 22, 23, 22', 23' is formed with a discontinuous body from the mating end 201, 201' to the tail end 203' 203' but via said IC 30, 30' to electrically connect said mating end 201, 201' and said tail end 203, 203', while each of the remainder contacts 21, 24, 21', 24' have the parallel connection relation with the 30, 30' IC is formed with a continuous body from the mating end 201, 201' to the tail end 203, 203' with the IC 30, 30' being connected to a bypass of said continuous body. The contacts 22, 23, 22', 23' having the series connection relation with the IC are the signal contacts while the contacts 21, 24, 21', 24' having the parallel connection relation with the IC are the power contacts.

It should be noted that the IC according to the present invention could be any electrical device or component which is typically installed on a PCB. The IC, the electrical contacts and the insulative housing are combining into a single unit to mount to the PCB simultaneously. The IC is corresponding to all of the electrical contacts thereby each contacts is electrical connected with of the IC. Furthermore, the electrical contacts 20, 20' of the present invention are directly electrical connected with the IC with any electrical elements such as a substrate or the like. Therefore, the structure of electrical connector is simplified.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

a metallic shell defining a receiving space therein;

an insulative housing disposed within the receiving space, and including a body and a contact insert assembled therein, said body comprising a base and a tongue projecting from the base;

a plurality of electrical contacts secured to the contact insert and each comprising a mating end arranged on the tongue, a solder end projecting out of the insulative housing, and at least one connecting end located therebetween, the contact insert defining a recess in which connecting ends of the contacts are exposed; and an IC (Integrated Circuit) arranged within the recess of the contact insert and comprising a plurality of contact pads for electrical connecting with the connecting ends of the electrical contacts respectively; wherein the base defines a receiving space for receiving the contact insert and the contact insert has a support section for supporting the IC and a plurality clips adjacent to the recess.

2. The electrical connector as claimed in claim 1, wherein each connecting end has a projection for contacting with the IC, and the connecting ends and the clips of the contact insert are located at opposite sides of the IC for securing the IC therebetween.

3. The electrical connector as claimed in claim 1, wherein part of the electrical contacts are includes two separated sections, wherein one section is the mating end and the other section is the solder end; and part of the contacts are integral.

4. The electrical connector as claimed in claim 3, wherein said contacts with two separated sections defines two connecting ends on the separated sections respectively, and said integral contacts each has a connecting ends.

5. The electrical connector as claimed in claim 1, wherein the contacting ends and the solder ends of the electrical contacts are located in one plane.

6. The electrical connector as claimed in claim 1, wherein the contact insert has a pair of opposite side faces and the IC is located therebetween.

7. An electrical connector comprising:

an insulative housing with a tongue;

a plurality of electrical contacts secured to the insulative housing and each comprising a mating end arranged on the tongue, a solder end projecting out of the insulative housing and at least one connecting end located therebetween; and an ESD (Electrostatic Discharge) device assembled to insulative housing and comprising an insulative section and a plurality of contacting pads for electrical connecting with the connecting ends of the electrical contacts respectively; wherein part of the electrical contacts are includes two separated sections, wherein one section is the mating end and the other section is the solder end; and part of the contacts are integral; wherein said contacts with two separated sections defines two connecting ends on the separated sections respectively, and said integral contacts each has a connecting ends.

8. The electrical connector as claimed in claim 7, wherein the insulative housing has a body and a contact insert, said body comprising a base defining a receiving space for receiving the contact insert and the tongue extends from the base, and the electrical contacts are secured to the contact insert.

9. The electrical connector as claimed in claim 8, wherein the contact insert defines a recess for receiving the ESD device.

10. The electrical connector as claimed in claim 9, wherein the contact insert has a support section for supporting the ESD device and a plurality clips adjacent to the recess.

11. The electrical connector as claimed in claim 10, wherein each connecting end has a projection for contacting with the ESD device, and the connecting ends and the clips of the contact insert are located at opposite sides of the ESD device for securing the ESD device therebetween.

12. The electrical connector as claimed in claim 7, wherein the connecting ends of the electrical contacts are solder to the contacting pads of the ESD device.

13. An electrical connector for mounting to a printed circuit board and mating to a complementary connector, comprising:

an insulative housing defining a mating port;

a plurality of contacts disposed in the housing, each of said contacts including a mating end exposed in the mating port for mating with the complementary connector, and a tail end for mounting to the printed circuit board; and an Integral Circuit (IC) associated with the housing for Electrostatic Discharge (ESD) protection and including a plurality of contacting pads thereof; wherein some of said contacts are mechanically and electrically connected to the corresponding contacting pads with a series connection relation with the IC while the remainders are mechanically and electrically connected to the other corresponding contacting pads with a parallel connection relation with the IC; wherein each of said some of the contacts having the series connection relation with the IC is formed with a discontinuous body from the mating end to the tail end but via said IC to electrically connect said mating end and said tail end, while each of the remainders having the parallel connection relation with the IC is formed with a continuous body from the mating end to the tail end with the IC being connected to a bypass of said continuous body.

14. The electrical connector as claimed in claim 13, wherein only said tail ends are configured to be mechanically and electrically connected to the printed circuit board for the connector and the associated IC.

15. The electrical connector as claimed in claim 13, wherein the contacts having the series connection relation with the IC are the signal contacts while the contacts having the parallel connection relation with the IC are the power contacts.

* * * * *